US008225741B2

(12) United States Patent
Dixon et al.

(10) Patent No.: US 8,225,741 B2
(45) Date of Patent: Jul. 24, 2012

(54) AUTOMATED PROCESSING LINE FOR APPLYING FLUID TO LENGTHS OF PIPE

(75) Inventors: Carl A. Dixon, Pleasant Grove, AL (US); Don R. Butler, Jr., Odenville, AL (US); James R. Harrington, Leeds, AL (US); Chris L. Hyche, Birmingham, AL (US)

(73) Assignee: McWane Cast Iron Pipe Company, Birmingham, AL (US)

( * ) Notice: Subject to any disclaimer, the term of this patent is extended or adjusted under 35 U.S.C. 154(b) by 680 days.

(21) Appl. No.: 12/361,158

(22) Filed: Jan. 28, 2009

(65) Prior Publication Data

US 2010/0189909 A1 Jul. 29, 2010

(51) Int. Cl.

| | |
|---|---|
| ***B05C 3/00*** | (2006.01) |
| ***B05C 19/02*** | (2006.01) |
| ***B08B 3/00*** | (2006.01) |
| *B05D 1/18* | (2006.01) |
| *B05D 7/22* | (2006.01) |

(52) U.S. Cl. . 118/428; 118/416; 118/423; 118/DIG. 12; 427/430.1; 427/232; 134/82

(58) Field of Classification Search ..... 118/400, 118/423, 426, DIG. 12; 427/430.1
See application file for complete search history.

(56) References Cited

U.S. PATENT DOCUMENTS

| | | | | |
|---|---|---|---|---|
| 1,521,010 | A | | 12/1924 | Cunningham |
| 1,755,634 | A | | 4/1930 | Dewey |
| 1,789,596 | A | * | 1/1931 | Potthoff ..... 205/151 |
| 1,854,395 | A | | 4/1932 | Cummings |
| 1,935,087 | A | | 11/1933 | Free |
| 2,114,974 | A | | 4/1938 | Camerota |
| 2,741,252 | A | * | 4/1956 | Davis ..... 134/76 |
| 3,622,294 | A | * | 11/1971 | Loukes et al. ..... 65/142 |
| 3,701,336 | A | | 10/1972 | McConnell et al. |
| 3,978,816 | A | | 9/1976 | Saloom |
| 4,057,070 | A | * | 11/1977 | van Amerongen et al. ..... 134/83 |
| 4,073,978 | A | * | 2/1978 | Womack et al. ..... 427/235 |
| 4,392,506 | A | * | 7/1983 | Tanaka et al. ..... 134/46 |
| 5,413,638 | A | | 5/1995 | Bernstein, Jr. et al. |
| 5,474,610 | A | * | 12/1995 | Jorgens ..... 118/423 |
| 5,704,979 | A | * | 1/1998 | Jorgens ..... 118/423 |
| 5,939,145 | A | | 8/1999 | Oram |

* cited by examiner

*Primary Examiner* — Dah-Wei Yuan
*Assistant Examiner* — Karl Kurple
(74) *Attorney, Agent, or Firm* — C. Brandon Browning; Maynard Cooper & Gale, PC

(57) ABSTRACT

An apparatus and method for applying a fluid such as paint to the surfaces of a plurality of lengths of pipe, the apparatus including an automated processing line composed of a receiving platform configured for receiving the plurality of lengths of pipe, a vat down the line from the receiving platform for containing the fluid, a draining platform down the line from the vat, the draining platform being configured for elevating an end of each length of pipe of the plurality of lengths of pipe relative to an opposite end of the length of pipe, and a conveyor system configured for engaging the plurality of lengths of pipe and advancing the plurality of lengths of pipe through the vat and across the draining platform by rolling. In use, the plurality of lengths of pipe are loaded onto the pipe receiving platform, rolled into the vat one length of pipe at a time, advanced through the vat by receiving each length of pipe of the plurality of lengths of pipe between a pair of teeth extending downward from the conveyor system, and rolling the plurality of lengths of pipe through the vat, out of the vat and across the draining platform by advancing the conveyor system.

21 Claims, 10 Drawing Sheets

AUTOMATED PROCESSING LINE FOR APPLYING FLUID TO LENGTHS OF PIPE

FIELD OF THE INVENTION

This invention relates to an apparatus and method for coating tubular workpieces. More particularly, the invention relates to an automated processing line for continuously painting lengths of pipe.

BACKGROUND OF THE INVENTION

Devices for coating pipes are known in the art. For example, U.S. Pat. No. 1,521,010 describes a coating machine including a drum and a shaft centrally located within the drum that is provided with star wheels spaced apart and keyed to the shaft. The star wheels are provided with notches to receive tubes to be coated. In use, the shaft is caused to rotate in an anti-clockwise direction. The tubes are allowed to travel into the notches by moving over an intake platform. As the star wheels carry the tubes in an anti-clockwise direction down through a liquid bath, they are coated. After coating, the tubes are released from the drum and rolled out through an opening on to an incline platform.

U.S. Pat. No. 2,114,974 describes an apparatus for coating pipes including a supply station, a heating station, a vat containing a coating material, a drying station where the pipes are drained of excess coating material, a discharge station and conveying means for transferring the pipe horizontally and with step-by-step progression through a series of stations. In use, the pipes are brought to the coating machine by causing them to roll on spaced parallel rails elevated above the floor of the foundry, at the supply station. The pipes received at the supply station are admitted one at a time to a conveyor including a pair of spaced parallel skids having notches at regular intervals there along. The pipes are then rolled onto supporting surfaces where they are temporarily arrested by the ends of a pair of pipe-carrying fingers, preparatory to immersion in vat. In order to effect the rolling of the pipes into the vat with guided and controlled movement, the pipe-carrying fingers are pivotally mounted and are operated in timed relation with the conveyor. After immersion in the vat the pipe is carried upwardly and caused to roll along the top edges of the pipe-carrying fingers to a draining station including an inclined plate leading downwardly toward the vat and over which excess coating material drained from the pipes is caused to return to the vat.

SUMMARY OF THE INVENTION

The present invention is directed to an apparatus and method for continuously coating lengths of pipe. In one aspect of the invention there is provided an automated processing line for applying a fluid to a plurality of lengths of pipe including a receiving platform configured for receiving the plurality of lengths of pipe, a vat down the line from the receiving platform, a draining platform down the line from the vat, the draining platform being configured for elevating an end of each length of pipe of the plurality of lengths of pipe relative to an opposite end of the length of pipe, and a conveyor system configured for engaging the plurality of lengths of pipe and advancing the plurality of lengths of pipe through the vat and across the draining platform, the conveyor system including a first row of teeth forming a first row of gaps, and a second row of teeth forming a second row of gaps. Preferably, the draining platform includes a set of rails extending down the line from the vat, the set of rails including a first rail and a second rail, the first rail including a first portion that is elevated relative to a second portion of the second rail that is adjacent to the first portion. A recycling station can be arranged underneath the second portion of the second rail for collecting a fluid drained from the plurality of lengths of pipe and returning the fluid to the vat, and a drying station provided down the line from the draining station for blowing air across and through the plurality of lengths of pipe.

A further aspect of the invention is directed to a method of applying a fluid to a pipe including loading the pipe into an automated processing line, positioning the pipe adjacent to a vat containing the fluid, rolling the pipe into the vat, wherein the pipe is at least partially immersed in the fluid, providing a conveyor system including a first row of teeth forming a first row of gaps that open downward toward the vat, and a second row of teeth forming a second row of gaps that open downward toward the vat, receiving a first end of the pipe within a first gap of the first row of gaps and second end of the pipe within a second gap of the second row of gaps, rolling the pipe across an inner surface of the vat by advancing the first row of teeth and the second row teeth down the line, and rolling the pipe out of the vat by advancing the first row of teeth and the second row of teeth down the line. The pipe is rolled out of the vat and through a draining station by advancing the first row of teeth and the second row teeth down the line. Preferably, rolling the pipe through the draining station includes rolling the pipe down the line while elevating the first end of the pipe relative to the second end of the pipe.

In yet another aspect of the invention there is provided an automated processing line for applying a fluid to a plurality of lengths of pipe including a pipe receiving platform, a vat containing the fluid, the vat being down the line from the pipe receiving platform, a pipe draining platform positioned down the line from the vat, and a conveyor system substantially extending above and between the vat and the pipe draining platform, the conveyor system being configured for engaging the plurality of lengths of pipe and advancing the plurality of lengths of pipe through the vat and across the draining platform by rolling. Preferably, the draining platform includes a set of rails extending down the line from the vat, the set of rails including a first rail and a second rail, the first rail including a first portion that is elevated relative to a second portion of the second rail that is adjacent to the first portion. It is also preferred that the conveyor system include a plurality of teeth that extend downward toward the vat and draining platform. In use, the plurality of lengths of pipe are loaded onto the pipe receiving platform and rolled into the vat one length of pipe at a time. Thereafter, each length of pipe of the plurality of lengths of pipe is received between a pair of teeth of the plurality of teeth, and rolled through the vat, out of the vat and across the draining platform by advancing the plurality of teeth.

DETAILED DESCRIPTION OF PRESENTLY PREFERRED EMBODIMENTS

Figure 1:
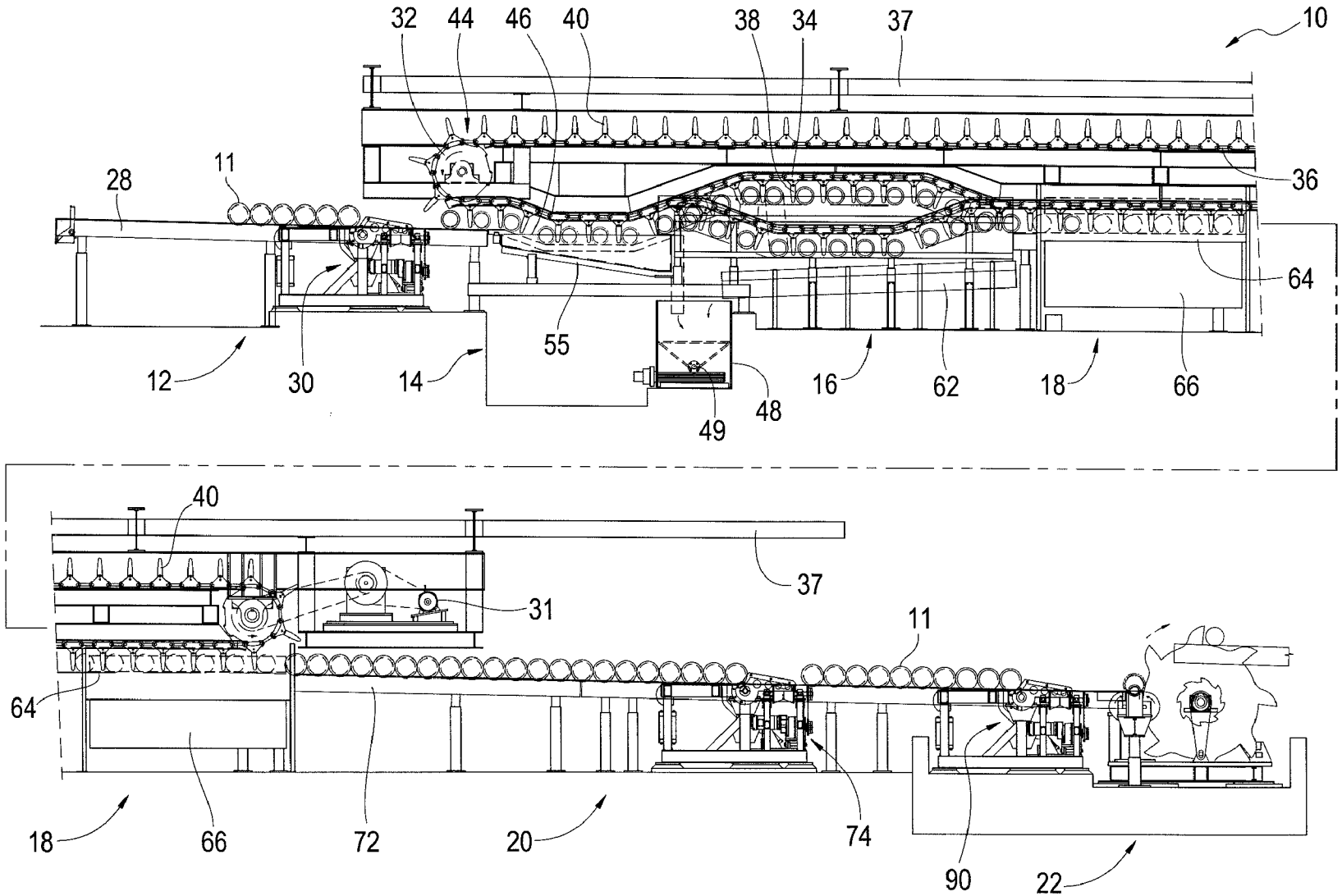
FIG. 1 is an elevational view of an automated processing line for coating a plurality of lengths of pipe in accordance with a preferred embodiment of the present invention.
Figure 2:
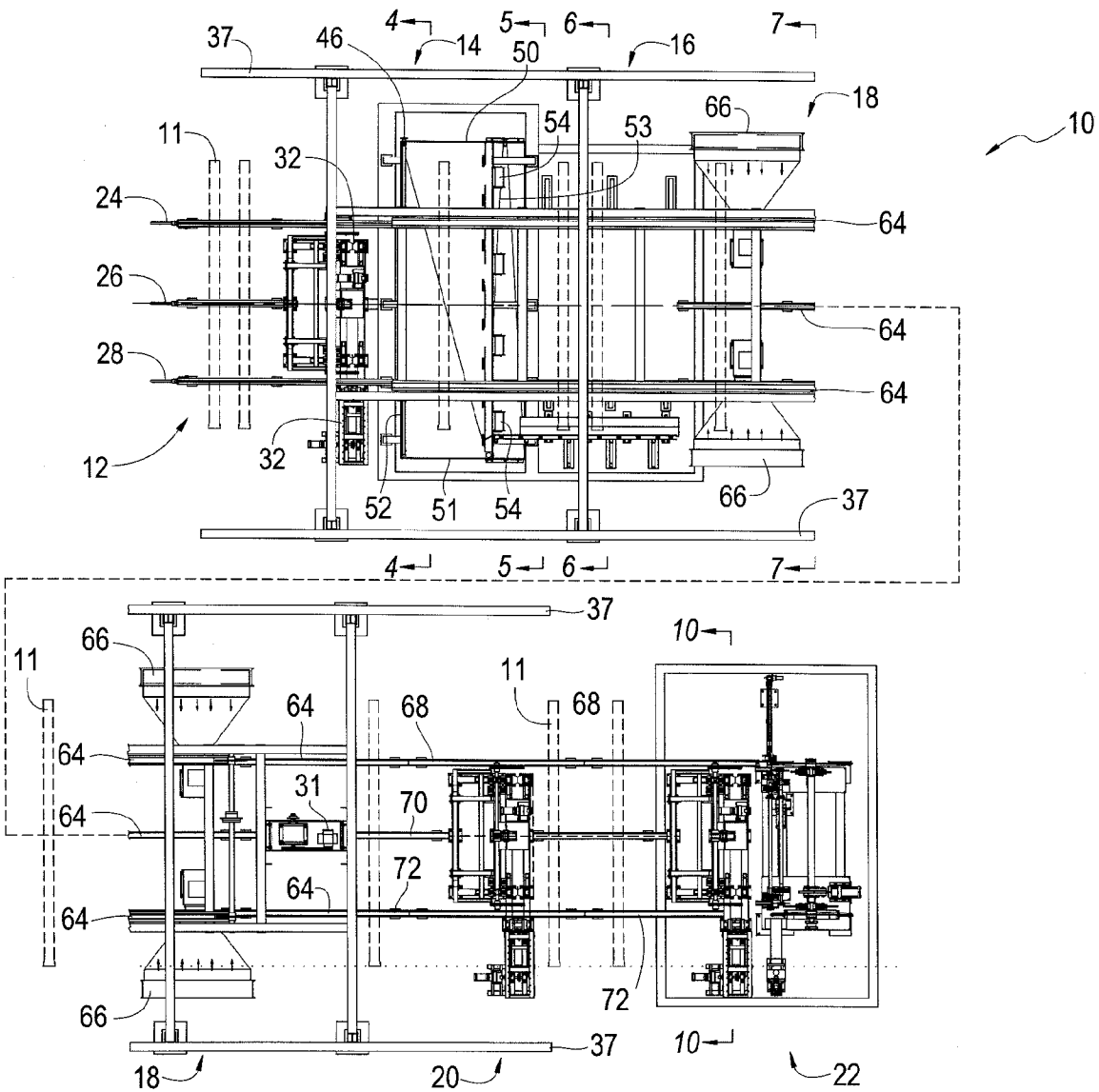
FIG. 2 is a top plan view of the process line of FIG. 1.

The preferred embodiment of the present invention is illustrated in FIGS. 1 through 10, where like portions share like numbering. Generally, as illustrated at FIGS. 1 and 2, an automated processing line 10 for coating a plurality of lengths of pipe 11 in accordance with the preferred embodiment of the present invention includes a pipe receiving section 12, a painting section 14, a paint draining section 16, a paint drying section 18, a holding section 20 and a stripe applying section 22. A conveyor system is provided for conveying plurality of lengths of pipe 11 horizontally and with step-by-step progression through sections 12, 14, 16, 18, 20 and 22.

More particularly, as illustrated in FIGS. 1 and 2, pipe receiving section 12 includes three elevated loading rails 24, 26 and 28 arranged in parallel to one another and angled slightly downward toward painting section 14 for allowing plurality of lengths of pipe 11 to advance by rolling toward painting section 14 when placed onto the upper ends of rails 24, 26 and 28. Loading rails 24 and 28 extend from their respective upper ends to painting section 14 for delivering plurality of lengths of pipe 11 directly thereto. Loading rail 26, which is located between rails 24 and 28, extends from its upper end toward painting section 12 but terminates before reaching painting section 14 at a conventional pipe loader 30. Pipe loader 30, which is described in further detail hereafter, serves to arrest the advance of plurality of lengths of pipe 11 down loading rails 24 and 28 and selectively receives and releases one length of pipe 11 at a time for progression by rolling toward painting section 14. While a length of pipe 11 is arrested by pipe loader 30, a pipe aligner 32, which is described in further detail hereafter, positions the length of pipe 11 so that it is properly aligned for loading into painting section 14.

Figure 3:
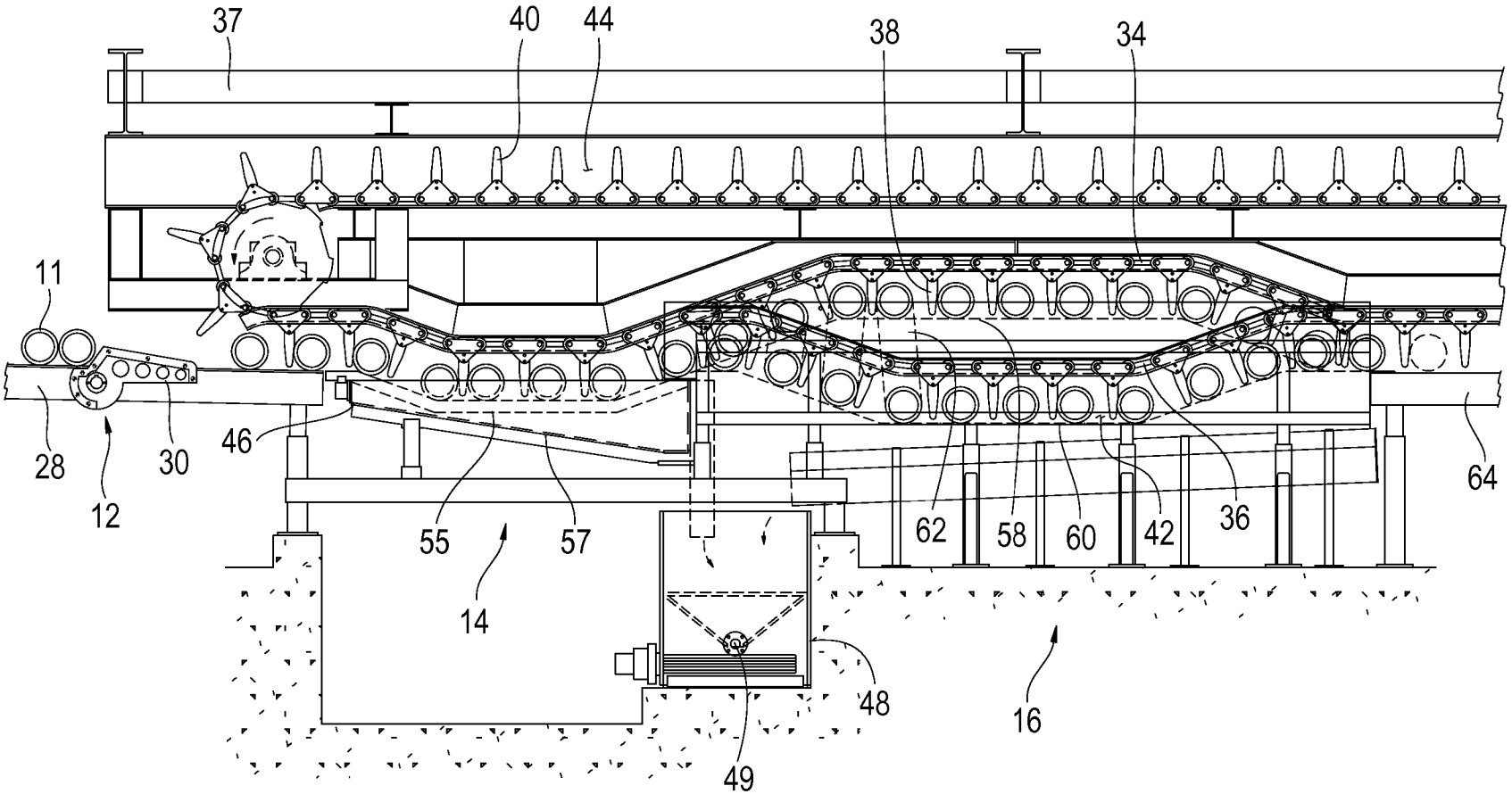
FIG. 3 is an elevational view of a the painting section and paint draining section of the process line of FIG. 1.

As illustrated in FIGS. 1 through 3, a length of pipe 11 released from pipe loader 30 rolls by gravity on top of loading rails 24 and 28 toward painting section 14 and is engaged by a conveyor 32 configured for advancing plurality of lengths of pipe, one by one, through sections 14, 16 and 18 of processing line 10. Conveyor 32 includes a motor 31 and a pair of motor driven tracks including a rigid first track 34 and an adjacent rigid second track 36. Tracks 34 and 36 are elevated above pipe receiving section 12, painting section 14, paint draining section 16, and paint drying section 18 and supported by a conveyor support frame 37. Tracks 34 and 36 include a plurality of interconnected fingers 38 and 40, respectively, that extend outward therefrom. Plurality of fingers 38 define a plurality of gaps 42 between adjacent fingers 38 of first track 34, with each gap 42 being aligned with a complimentary gap 44 defined by fingers 40 of second track 36. Each pair aligned gaps 42 and 44 is arranged to receive a single, length of pipe 11 and transport the length of pipe through painting section 14, paint draining section 16 and paint drying section 18 by either pushing the pipe or arresting the pipe's progression as it rolls by gravity of otherwise.

Figure 4:
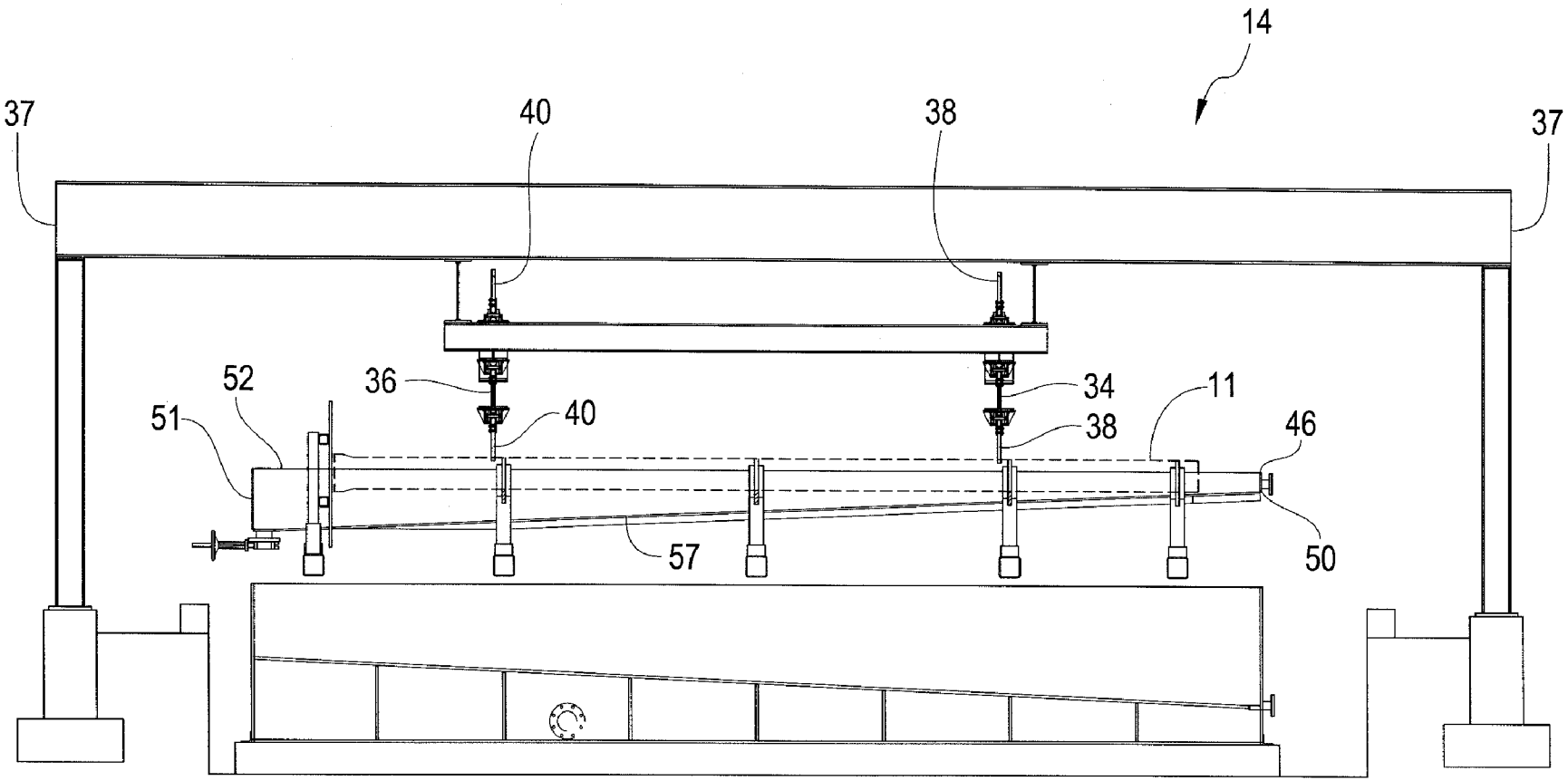
FIG. 4 is a sectional view of the process line of FIG. 2 along line 4-4.

Referring to FIGS. 3 and 4, after a length of pipe 11 is released from pipe loader 30, the pipe rolls by gravity toward painting section 14 before being arrested by fingers 38 and 40. In particular, as tracks 34 and 36 progress, complementary pairs of fingers 38 and 40 are cycled toward pipe receiving portion 12 and rotated downward in the direction of loading rails 24 and 28. At the point where a pair of fingers 38 and 40 become substantially perpendicular with loading rails 24 and 28, a length of pipe 11 rolls forward and is stopped by the fingers. As tracks 34 and 36 continue to progress, a second pair of complementary fingers 38 and 40 are cycled toward pipe receiving portion 12 and rotated downward toward loading rails 24 and 28. The second pair of complementary fingers 38 and 40 follow behind the first pair of leading fingers 38 and 40 thereby forming a pair of aligned gaps 42 and 44 there between. The length of pipe 11 becomes trapped within gaps 42 and 44 and is pushed forward by the following or second pair of finger 38 and 40 into painting section 14.

As illustrated in FIGS. 1 through 4, painting section 14 includes a vat 46 for containing a paint or other fluid to be applied to the surface of plurality of lengths of pipe 11, a reservoir 48 for collecting and storing the paint and a recycling pump 49 for pumping the paint from reservoir 48 to vat 46. Vat 46 has four, continuous side walls 50, 51, 52 and 53, each sidewall being connected to an adjacent sidewall at a 90° angle. Sidewalls 50, 51, 52 and 53 extend toward a floor 57 that slopes downward toward paint draining section 18 and sidewall 53. Accordingly, the depth of vat 46 gradually increases from sidewall 52, which is located adjacent to pipe receiving section 12, to sidewall 53, which is located adjacent to pipe draining section 16. The upper edge of the sidewall 53 includes a plurality of weirs 54 provided to ensure that paint depth within vat 46 does not rise above a predetermined level as paint is pumped into vat 46 from reservoir 48. Thus, when paint is pumped from reservoir 48 by pump 49 into vat 46, excess paint pours out of vat 46 through weirs 54. This way, the paint level is kept constant while vat 46 is supplied with well mixed and circulated paint.

Referring to FIG. 3, a pair of rails 55 extend in parallel between sidewalls 52 and 53 of vat 46 for receiving plurality of lengths of pipe 11 directly from loading rails 24 and 28. Pair of rails 55 extend horizontally from loading rails 24 and 28 and above sidewall 52 before angling downward a predetermined depth within vat 46. A substantially horizontal section extends therefore before angling upward and over sidewall 53. In use, the length of pipe 11 trapped within gaps 42 and 44 and is pushed forward by the second pair of fingers 38 and 40 onto pair of rails 55 and into vat 46 until the pipe reaches the portion of pair of rails 55 that is angled downward. At this point, length of pipe 11 rolls forward into the paint and is arrested by the first or leading pair of fingers 38 and 40 until it is again pushed forward and rolled across the horizontal portion of pair of rails 55 where the pipe is coated. The depth of the paint within vat 46 relative to the depth of pair of rails 55 is such that approximately only half of length of pipe 11 is submerged within the paint as it is rolled across pair of rails 55.

Figure 5:
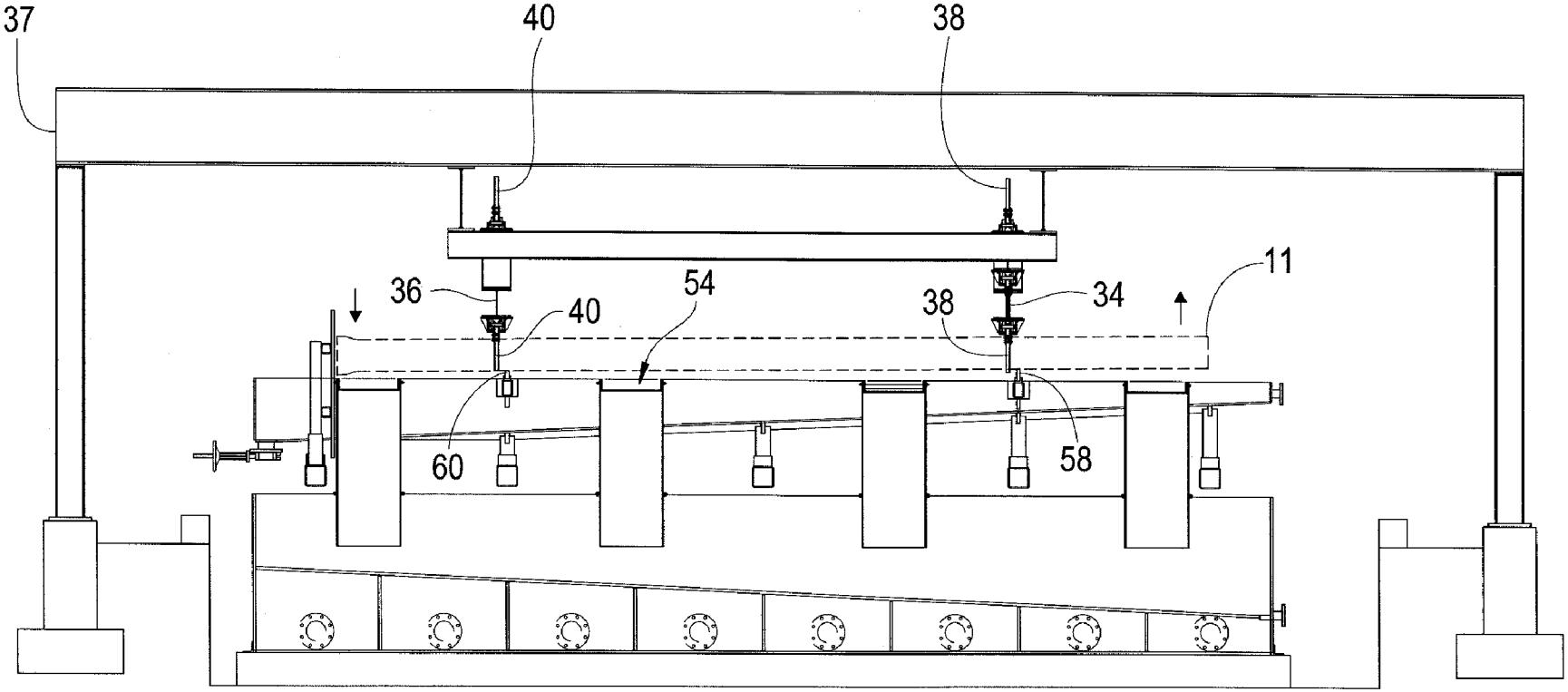
FIG. 5 is a sectional view of the process line of FIG. 2 along line 5-5.
Figure 6:
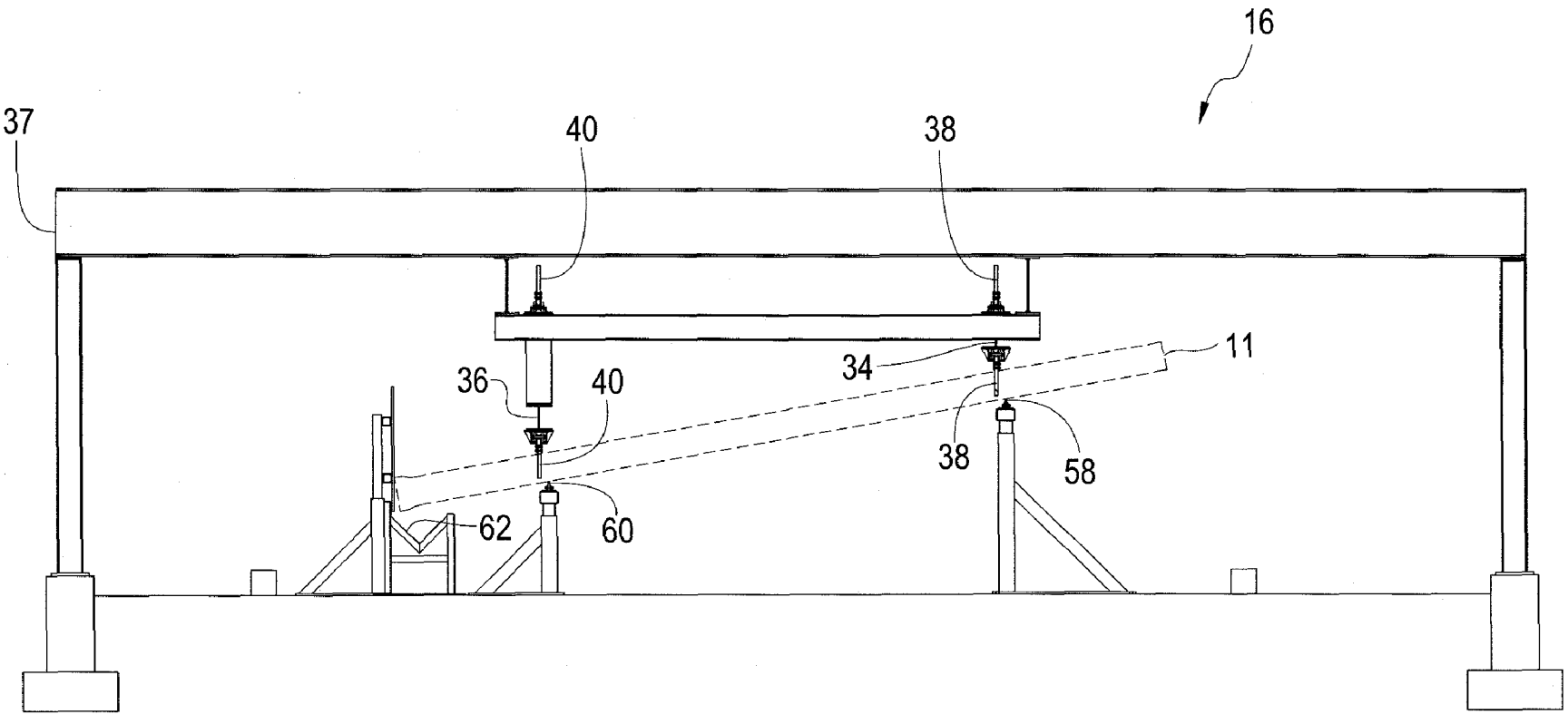
FIG. 6 is a sectional view of the process line of FIG. 2 along line 6-6.

As illustrated in FIGS. 3 and 5, after a length of pipe 11 is coated, it is pushed upward along pair of rails 55 and over sidewall 53 into paint draining section 16 where it is briefly maintained in a horizontal orientation before being tilted for allowing excess paint on the surface and interior of the pipe to drain off of the pipe. More particularly, referring to FIG. 6, paint draining section 16 includes a pair of adjacent draining rails that extend directly from pair of rails 55 for receiving length of pipe 11. Specifically, there is a first draining rail 58 and a second draining rail 60. Rather than extending in parallel, first draining rail 58 and second draining rail 60 diverge with first draining rail extending upward from painting section 14 and second draining rail extending downward from painting section 14. This way, length of pipe 11 is tilted upward at one end and downward at the opposite end to allow excess paint to drain from the pipe. A tilted pipe is shown in FIGS. 3 and 6 at 62. After extending upward, draining rail 58 extends horizontally before angling downward to be parallel with draining rail 60. Likewise, after extending downward, draining rail 60 extends horizontally before angling upward to be parallel with draining rail 58.

As length of pipe 11 enters into paint draining section 16, a first end of pipe 11 is pushed upward and rolled along draining rail 58 by a following finger 38 of track 34. At the same time, a second end of pipe 11 is rolled downward along an adjacent portion of draining rail 60 before its progression is arrested by a leading finger of track 36. As this occurs, the first end of pipe 11 is raised above the second end of the pipe a predetermined amount to place the pipe a desired angle for draining paint from the pipe. After this transition period, length of pipe 11 is pushed forward within aligned gaps 42 and 44 by the following pair of fingers 38 and 40 and rolled along the horizontal sections of draining rails 58 and 60 which extend substantially parallel to one another. While length of pipe 11 is tilted and rolled through paint drying section 16, the excess paint drained from the pipe is collected in a trough 62 positioned beneath the second end of the pipe. Trough 62 is angled toward reservoir 48 and arranged to deliver the drained paint directly into reservoir 48. Following draining, the first end of length of pipe 11 is allowed to roll downward along draining rail 58 toward drying section 18, its progression being arrested by leading finger 38 of track 34. At the same time, the second end of length of pipe 11 is pushed upward and rolled along an adjacent portion of draining rail 60 by following finger 40 of track 36 until the pipe is in a horizontal orientation.

Figure 7:
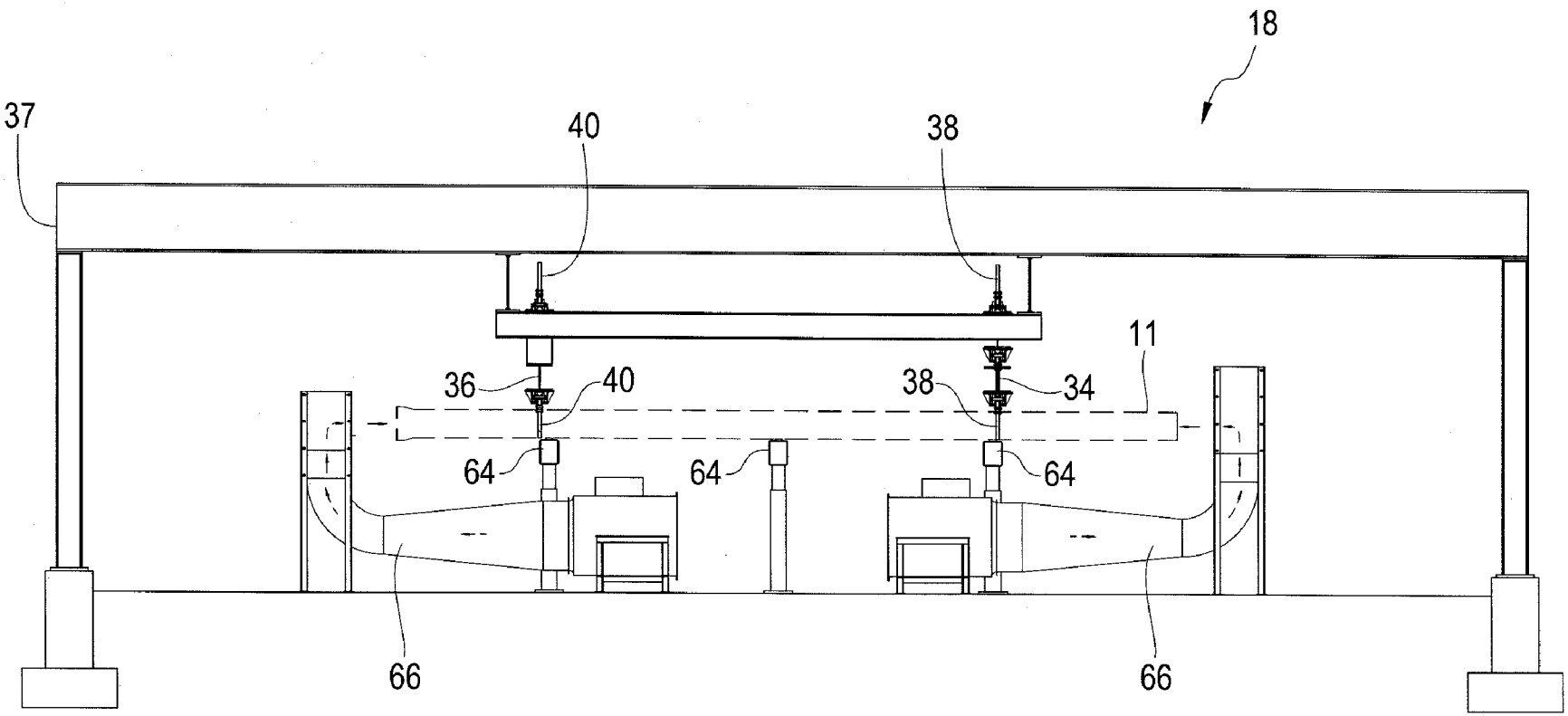
FIG. 7 is a sectional view of the process line of FIG. 2 along line 7-7.
Figure 8:
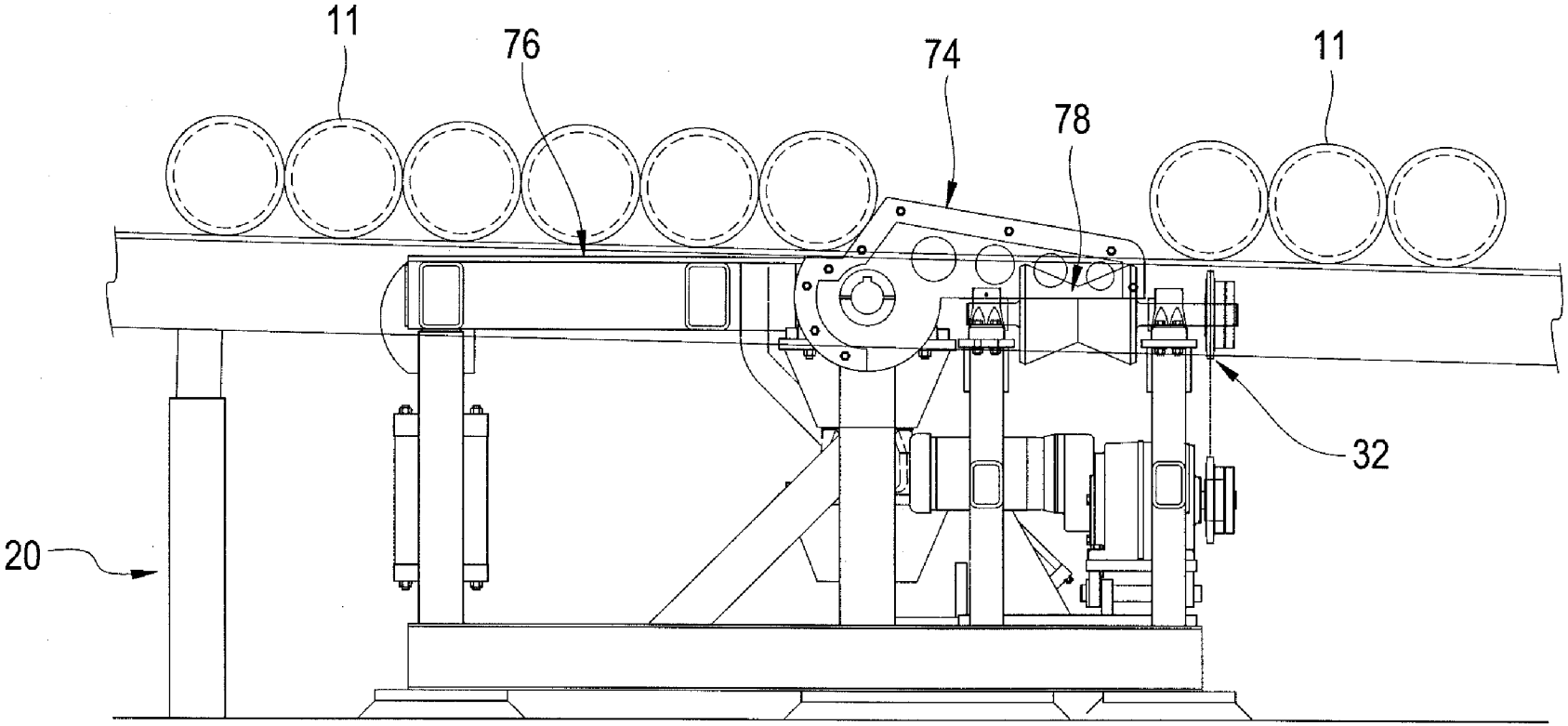
FIG. 8 is an elevational view of a pipe loader in the holding section of the process line of FIG. 1.

As illustrated in FIGS. 1, 3 and 7, length of pipe 11 is delivered directly from painting draining section 16 to paint drying section 18. In particular, paint drying section 18 includes a set of three elevated, substantially horizontal drying rails 64 for receiving length pipe 11 from paint draining section 16 and supporting pipe 11 as it is rolled through paint drying section 18 by conveyor 32. Section 18 further includes two pairs of opposed blowers 66 for directing flows of air across and through length of pipe 11 as it is rolled along drying rails 64. Preferably, each pair of opposed blowers are offset with one blower directing a flow of air through the interior of length of pipe 11 with the other blower directing a flow of air along the upper surface of the exterior of pipe 11. After drying, length of pipe 11 is rolled along drying rails 64 by conveyor 32 until the pipe is released from pair of aligned gaps 42 and 44 as fingers 38 and 40 are cycled back toward pipe receiving section 12.

As illustrated in FIGS. 1 and 2, when length of pipe 11 is released from conveyor 32 it is deposited onto a set of three parallel holding rails 68, 70 and 72. Holding rails 68, 70 and 72 are angled downward toward striping section 22 to allow length of pipe 11 to roll by gravity down the line. However, a second pipe loader 74 arrests the forward progress of length of pipe 11 along rails 68 and 72. Second pipe loader 74 is provided to correct the angle of pipe 11 in relation to the center line of automated process line 10 to a perpendicular orientation. In operation, a lift table 76 elevates pipe 11 and pipe 11 progresses to pipe loader 74 by means of gravity. When pipe 11 contacts each end of pipe loader 74, it is perpendicular to the center line of automated process line 10. Pipe loader 74 then rotates, lifting pipe 11 into a pipe aligner 78 where pipe 11 is properly aligned thereby. Upon completion of alignment, pipe loader 74 rotates back to the original position which causes pipe 11 to be forced out of aligner 78 and onto rails 68 and 72.

Figure 9:
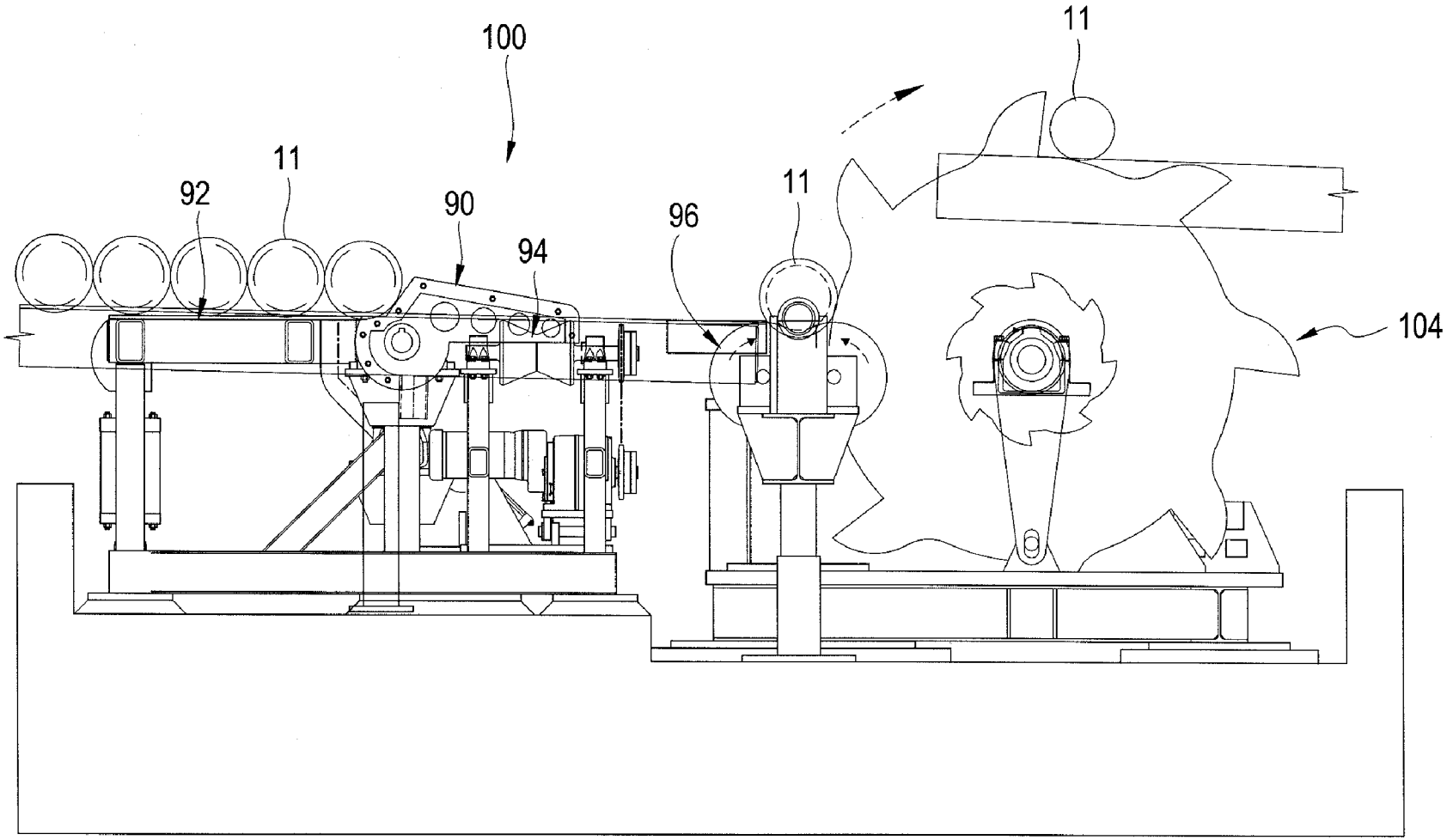
FIG. 9 is an elevational view of the striping section of the process line of FIG. 1.
Figure 10:
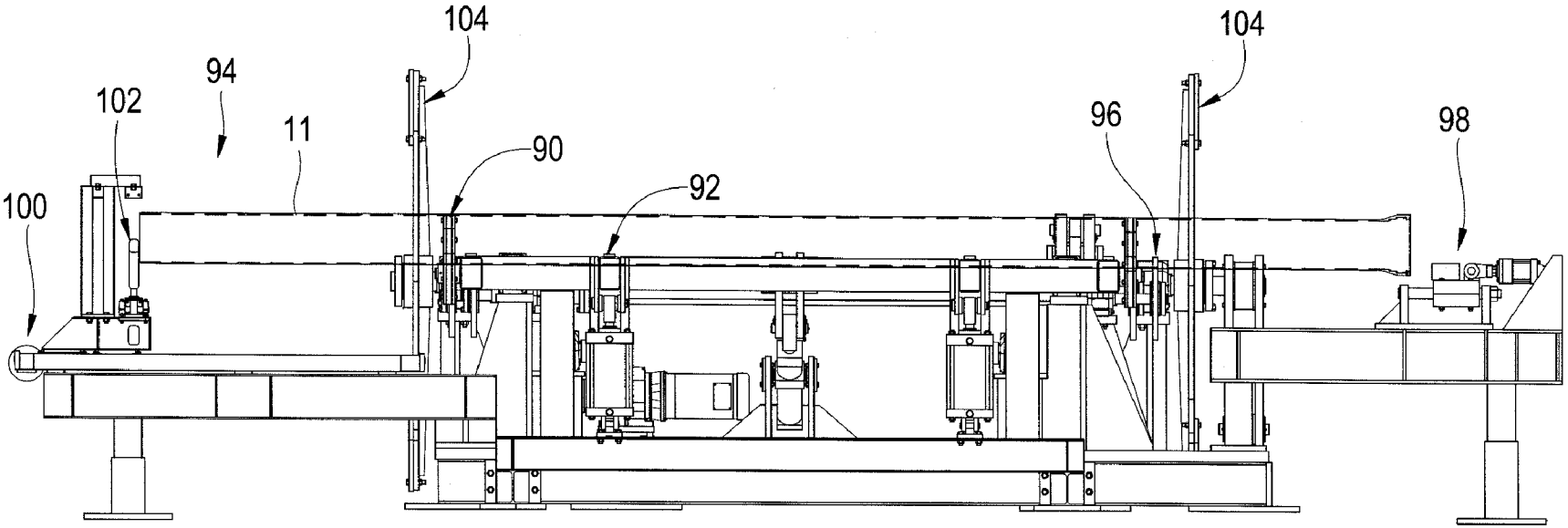
FIG. 10 is a sectional view of the striping section of the process line of FIG. 2 along line 10-10.

Referring to FIGS. 9 and 10, once a length of pipe 11 is released by pipe loader 74, the pipe rolls by gravity down rails 68 and 72 to a third pipe loader 90. Pipe loader 90 delivers a single length of pipe 11 to striping section 22. Pipe loader includes a lift table 92 and operates in the same manner as pipe loaders 74 and 30. Striping section 22 includes a second pipe aligner 92 for aligning the pipe before it is received by a striper 94 for applying a stripe to one end of the pipe. Striper 94 receives pipe 11 into a set of rotating rolls 96 which cause pipe 11 to rotate. A pneumatic butt roller 98 is extended to hold pipe 11 in a set position in relation to automated process line 10. With pipe 11 rotating and touching butt roller 98, a linear actuator 100 carries a paint striper head 102 forward. Paint striper head 102 sprays a two stripe pattern on the spigot end of pipe 11, then linear actuator 100 moves paint striper head 102 back away from pipe 11. When striper head 102 has completed painting the two stripe pattern a star wheel 104 lifts pipe 11 out of rotating rolls 96 and delivers pipe 11 to a different stage in the manufacture of the lengths of pipe 11.

As will be apparent to one skilled in the art, various modifications can be made within the scope of the aforesaid description. Such modifications being within the ability of one skilled in the art form a part of the present invention and are embraced by the claims below.

It is claimed:

1. An automated processing line for applying a fluid to a plurality of lengths of pipe comprising, a receiving section configured for receiving the plurality of lengths of pipe, a vat down the line from the receiving platform, the vat being operatively coupled to the receiving section, a draining section down the line from the vat including a first rail and a second rail extending away from the vat in a direction of travel of the plurality of lengths of pipe, a first section of the first rail extending at a higher elevation and off to a lateral side of a second section of the second rail, a first length of pipe of the plurality of lengths of pipe supported on the first section of the first rail and the second section of the second rail in a tilted arrangement, and a conveyor system extending over the vat and the draining section, the conveyor system being configured to advance the plurality of lengths of pipe by rolling the plurality of lengths of pipe through the vat and draining section, wherein the first length of pipe has a first end and a second end, the first end of the first length of pipe being supported on an upper surface of the first section of the first rail and the second end of the first length of pipe being supported on an upper surface of the second section of the second rail and where the first length of pipe extends lengthwise and tilted across an upper surface of the first section of the first rail and an upper surface of the second section of the second rail.

2. The processing line according to claim 1 further comprising at least two rails extending side by side to one another across the vat and in the direction of travel of the plurality of lengths of pipe, the at least two rails being arranged within the vat relative to a fluid contained therein at a height where the plurality of lengths of pipe to be only partially submerged in the fluid as the plurality of lengths of pipe are rolled across the at least two rails.

3. The processing line according to claim 1 wherein the first rail includes an upwardly angled first portion, a horizontal second portion and a downwardly angled third portion, the second portion being located between the first portion and the third portion.

4. The processing line according to claim 3 wherein the first portion is adjacent to the vat.

5. The processing line according to claim 3 wherein the second rail includes a downwardly angled fourth portion, a horizontal fifth portion and an upwardly angled sixth portion, the fifth portion being located between the fourth portion and the sixth portion.

6. The processing line according to claim 5 wherein the first portion and the fourth portion are adjacent to the vat.

7. The processing line according to claim 1 further comprising a recycling apparatus including a collecting member arranged for collecting a fluid drained from the plurality of lengths of pipe in the draining section and pumping member for transporting the drained fluid to the vat.

8. The processing line according to claim 1 further comprising a drying section down the line from the draining section, the drying section including one or more blowers arranged to blow air across and through the plurality of lengths of pipe.

9. The processing line according to claim 1 wherein a section of the conveyor system that advances the plurality of lengths of pipe through the draining section includes a first track having a horizontal first portion and a second track having a horizontal second portion, the first portion being higher than the second portion.

10. The processing line according to claim 1 wherein a section of the conveyor system that advances the plurality of lengths of pipe through draining section includes a first track having an upwardly angled first portion, a horizontal second portion and a downwardly angled third portion, the second portion being located between the first portion and the third portion.

11. The processing line according to claim 10 wherein the section of the conveyor system that advances the plurality of lengths of pipe through draining section includes a second track having a downwardly angled fourth portion, a horizontal fifth portion and an upwardly angled sixth portion, the fifth portion being located between the fourth portion and the sixth portion.

12. The processing line according to claim 11 wherein the second portion and the fifth portion are parallel.

13. The processing line according to claim 1 wherein a section of the conveyor system that advances the plurality of lengths of pipe through the vat includes a track having a row of teeth extending downwardly therefrom into an open face of the vat.

14. An automated processing line for applying a fluid to a plurality of lengths of pipe comprising, a vat containing the fluid, a pipe draining section positioned down the line from the vat for draining a portion of the fluid from the plurality of lengths of pipe, the draining section including a first rail having a first portion and a second rail having a second portion, the first portion being higher than and arranged off to a lateral side of the second portion, a length of pipe of the plurality of lengths of pipe supported on the first portion of the first rail and the second portion of the second rail in a tilted arrangement, and a conveyor system extending between the vat and the pipe draining section, the conveyor system being configured for engaging the plurality of lengths of pipe and advancing the plurality of lengths of pipe one-by-one through the vat and draining section by rolling, wherein a section of the conveyor system that advances the plurality of lengths of pipe through the draining section includes a first track having a third portion and a second track having a fourth portion, the third portion being higher than and arranged adjacent to the fourth portion, wherein the first portion extends parallel to the third portion and the second portion extends parallel to the fourth portion wherein the length of pipe has a first end and a second end, the first end of the length of pipe being supported on an upper surface of the first portion of the first rail and the second end of the first length of pipe being supported on an upper surface of the second portion of the second rail and where the first length of pipe extends lengthwise and tilted across an upper surface of the first section of the first rail and an upper surface of the second section of the second rail.

15. An automated processing line for applying a fluid to a plurality of lengths of pipe comprising, a vat containing the fluid, a first pair of rails arranged side by side in the vat and extending under a surface of the fluid and in a direction of travel of the plurality of lengths of pipe, a draining section including a trough arranged to collect the fluid drained from the plurality of lengths of pipe, the trough being fluidly coupled to the vat, a second pair of rails operatively coupled to the first set of rails, the second pair of rails being arranged side by side within the draining section and extending away from the vat in the direction of travel of the plurality of lengths of pipe, and a conveyor including a continuous track that extends over the vat and the draining section in the direction of travel of the plurality of lengths of pipe, the track including plurality of downwardly extending teeth, wherein a first portion of the track is positioned at an elevation that is lower than a first section of a first rail of the second pair of rails and wherein the conveyor is configured to receive the plurality of lengths of pipe, where each pipe has a first end and a second end, the first end of each length of pipe being supported on an upper surface of the pair of rails in the draining section and where each length of pipe extends lengthwise and tilted across the pair of rails in the draining section.

16. The processing line according to claim 15 wherein the fluid is paint.

17. The processing line according to claim 15 wherein the elevation of the first portion of the track is higher than a second section of a second rail of the second pair of rails.

18. The processing line according to claim 17 further comprising a length of pipe of the plurality of pipes supported on the first section of the second rail and the second section of the second rail with one end of the length of pipe raised higher than another end of the length of pipe.

19. The processing line according to claim 15 wherein the first pair of rails are integral with the second pair of rails.

20. The processing line according to claim 15 wherein the conveyor track includes a pair of tracks arranged side by side.

21. The processing line according to claim 15 wherein the trough is positioned under the second pair of rails.

* * * * *